US006501450B1

(12) United States Patent
Bjerke

(10) Patent No.: US 6,501,450 B1
(45) **Date of Patent: *Dec. 31, 2002**

(54) SYSTEM FOR CONTRAST CONTROL USING LINEARIZED VARIABLE NETWORK OF PARALLEL RESISTIVE TERMS

(75) Inventor: Mark R. Bjerke, Waukesha, WI (US)

(73) Assignee: Rockwell Automation Technologies, Inc., Mayfield Heights, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/379,205

(22) Filed: Aug. 21, 1999

(51) Int. Cl.[7] ..... G09G 3/34; G09G 3/36

(52) U.S. Cl. ..... 345/84; 345/87; 345/690; 345/692; 348/676; 348/678

(58) Field of Search ..... 345/84, 87, 77, 345/63, 147, 690, 692; 348/686, 678, 673

(56) References Cited

U.S. PATENT DOCUMENTS 4,622,635 A * 11/1986 Chandra et al. ..... 166/53
4,836,308 A * 6/1989 Davis et al. ..... 177/25.14
4,861,156 A * 8/1989 Terry ..... 351/243
4,967,384 A * 10/1990 Molinar et al. ..... 364/567
5,029,982 A * 7/1991 Nash ..... 345/101
5,045,832 A 9/1991 Tam ..... 338/334
5,377,259 A * 12/1994 Butler et al. ..... 379/93
5,422,656 A * 6/1995 Allard et al. ..... 345/173
5,446,483 A * 8/1995 Duley ..... 345/212

* cited by examiner

*Primary Examiner*—Bipin Shalwala
*Assistant Examiner*—Jimmy H. Nguyen
(74) *Attorney, Agent, or Firm*—Himanshu S. Amin; Alexander M. Gerasimow; William R. Walbrun

(57) ABSTRACT

A system for controlling contrast of a liquid crystal display is provided by means of a parallel network of resistors. A processor controls general operations of the system and is configured to determine a desired contrast setting of the LCD. The processor is operative to assign a binary value corresponding to the desired contrast setting. A binary decoder is operatively coupled to the processor and is configured to receive the binary value of x bits from the processor. A circuit includes N number of resistors (N being an integer greater than x) configured to be coupled in parallel to effect a plurality of cumulative parallel resistance values for the circuit. The circuit is operatively coupled to the binary decoder. The binary decoder selectively combines the resistors to effect a specific cumulative parallel resistance value corresponding to the desired contrast setting.

16 Claims, 7 Drawing Sheets

0 = Resistor Element is open
1 = Resistor Element is connected 110 120 130 140

| Parallel Resistor Elements | | | Binary Control Value | | | | | Decoder Output | | | | | | | | Network Resistance | |
|---|---|---|---|---|---|---|---|---|---|---|---|---|---|---|---|---|---|
| | Calculated Resistance Ohms | Actual Resistance Ohms | B3 | B2 | B1 | B0 | DEC | R1 | R2 | R3 | R4 | R5 | R6 | R7 | Out hex | Actual Ohms | Desired Ohms |
| R1 | 151550.9 | 150000 | 0 | 0 | 0 | 0 | 0 | 0 | 0 | 0 | 0 | 0 | 0 | 0 | 000 | 10000.0 | 10000.0 |
| R2 | 70775.4 | 69800 | 0 | 0 | 0 | 1 | 1 | 1 | 0 | 0 | 0 | 0 | 0 | 0 | 001 | 9375.0 | 9333.3 |
| R3 | 30387.7 | 30000 | 0 | 0 | 1 | 0 | 2 | 0 | 1 | 0 | 0 | 0 | 0 | 0 | 002 | 8746.9 | 8666.7 |
| R4 | 10193.9 | 10000 | 0 | 0 | 1 | 1 | 3 | 1 | 1 | 0 | 0 | 0 | 0 | 0 | 003 | 8264.9 | 8000.0 |
| R5 | 16925.1 | 16900 | 0 | 1 | 0 | 0 | 4 | 0 | 0 | 1 | 0 | 0 | 0 | 0 | 004 | 7500.0 | 7333.3 |
| R6 | 3462.6 | 3480 | 0 | 1 | 0 | 1 | 5 | 0 | 1 | 1 | 0 | 0 | 0 | 0 | 006 | 6772.3 | 6666.7 |
| R7 | 1539.3 | 1540 | 0 | 1 | 1 | 0 | 6 | 0 | 0 | 0 | 0 | 1 | 0 | 0 | 010 | 6282.5 | 5000.0 |
| | | | 0 | 1 | 1 | 1 | 7 | 0 | 1 | 0 | 0 | 1 | 0 | 0 | 012 | 5763.7 | 5333.3 |
| RP | 10000 | 10000 | 1 | 0 | 0 | 0 | 8 | 0 | 0 | 0 | 1 | 0 | 0 | 0 | 008 | 5000.0 | 4666.7 |
| Rmin | 100 | | 1 | 0 | 0 | 1 | 9 | 1 | 1 | 0 | 1 | 0 | 0 | 0 | 00B | 4225.0 | 4000.0 |
| Rstep | 619 | | 1 | 0 | 1 | 0 | 10 | 1 | 1 | 1 | 1 | 0 | 0 | 0 | 00F | 3932.0 | 3333.3 |
| | | | 1 | 0 | 1 | 1 | 11 | 1 | 1 | 1 | 1 | 1 | 0 | 0 | 01F | 3189.8 | 2666.7 |
| | | | 1 | 1 | 0 | 0 | 12 | 0 | 0 | 0 | 0 | 0 | 1 | 0 | 020 | 2581.6 | 2000.0 |
| | | | 1 | 1 | 0 | 1 | 13 | 0 | 0 | 1 | 1 | 0 | 1 | 0 | 02C | 1920.5 | 1333.3 |
| | | | 1 | 1 | 1 | 0 | 14 | 0 | 0 | 0 | 0 | 0 | 0 | 1 | 040 | 1334.5 | 666.7 |
| | | | 1 | 1 | 1 | 1 | 15 | 1 | 1 | 1 | 1 | 1 | 1 | 1 | 07F | 799.9 | 0.0 |

Fig. 3a

0 = Resistor Element is open
1 = Resistor Element is connected

| Parallel Resistor Elements | | | Binary Control Value | | | | | Decoder Output | | | | | | | | Network Resistance |
|---|---|---|---|---|---|---|---|---|---|---|---|---|---|---|---|---|
| | Calculated Resistance Ohms | Actual Resistance Ohms | B3 | B2 | B1 | B0 | DEC | R1 | R2 | R3 | R4 | R5 | R6 | R7 | Out hex | Ohms |
| R1 | 603072.7 | 511000 | 0 | 0 | 0 | 0 | 0 | 0 | 0 | 0 | 0 | 0 | 0 | 0 | 000 | 8200.0 |
| R2 | 297436.4 | 243000 | 0 | 0 | 0 | 1 | 1 | 1 | 0 | 0 | 0 | 0 | 0 | 0 | 001 | 8070.5 |
| R3 | 144618.2 | 137000 | 0 | 0 | 1 | 0 | 2 | 0 | 1 | 0 | 0 | 0 | 0 | 0 | 002 | 7932.3 |
| R4 | 68209.09 | 68100 | 0 | 0 | 1 | 1 | 3 | 1 | 1 | 0 | 0 | 0 | 0 | 0 | 003 | 7811.1 |
| R5 | 93678.79 | 100000 | 0 | 1 | 0 | 0 | 4 | 0 | 0 | 1 | 0 | 0 | 0 | 0 | 004 | 7736.9 |
| R6 | 42739.39 | 45300 | 0 | 1 | 0 | 1 | 5 | 1 | 0 | 1 | 0 | 0 | 0 | 0 | 005 | 7621.5 |
| R7 | 35462.34 | 34000 | 0 | 1 | 1 | 0 | 6 | 0 | 0 | 0 | 0 | 1 | 0 | 0 | 010 | 7578.6 |
| | | | 0 | 1 | 1 | 1 | 7 | 1 | 0 | 0 | 0 | 1 | 0 | 0 | 011 | 7467.8 |
| RP | 8200 | 8200 | 1 | 0 | 0 | 0 | 8 | 1 | 1 | 1 | 0 | 0 | 0 | 0 | 007 | 7389.7 |
| | | | 1 | 0 | 0 | 1 | 9 | 0 | 0 | 0 | 1 | 0 | 0 | 0 | 008 | 7318.7 |
| | | | 1 | 0 | 1 | 0 | 10 | 0 | 0 | 1 | 0 | 1 | 0 | 0 | 014 | 7181.3 |
| | | | 1 | 0 | 1 | 1 | 11 | 1 | 0 | 1 | 0 | 1 | 0 | 0 | 015 | 7081.8 |
| | | | 1 | 1 | 0 | 0 | 12 | 1 | 0 | 0 | 0 | 0 | 1 | 0 | 021 | 6850.1 |
| | | | 1 | 1 | 0 | 1 | 13 | 0 | 0 | 1 | 0 | 0 | 1 | 0 | 024 | 6608.3 |
| | | | 1 | 1 | 1 | 0 | 14 | 0 | 1 | 0 | 0 | 1 | 1 | 0 | 032 | 6323.5 |
| | | | 1 | 1 | 1 | 1 | 15 | 0 | 0 | 0 | 1 | 1 | 1 | 0 | 038 | 5927.3 |

Fig. 4a

0 = Resistor Element is open
1 = Resistor Element is connected

| Parallel Resistor Elements | Calculated Resistance Ohms | Resistor Enable B3 | B2 | B1 | B0 | In DEC | Contrast Resistance Actual Ohms |
|---|---|---|---|---|---|---|---|
| R1 | 60000 | 0 | 0 | 0 | 0 | 0 | 10000.0 |
| R2 | 30000 | 1 | 0 | 0 | 0 | 1 | 8571.4 |
| R3 | 15000 | 0 | 1 | 0 | 0 | 2 | 7500.0 |
| R4 | 7000 | 1 | 1 | 0 | 0 | 3 | 6666.7 |
| RP | 10000 | 0 | 0 | 1 | 0 | 4 | 6000.0 |
| | | 1 | 0 | 1 | 0 | 5 | 5454.5 |
| | | 0 | 1 | 1 | 0 | 6 | 5000.0 |
| | | 1 | 1 | 1 | 0 | 7 | 4615.4 |
| | | 0 | 0 | 0 | 1 | 8 | 4117.6 |
| | | 1 | 0 | 0 | 1 | 9 | 3853.2 |
| | | 0 | 1 | 0 | 1 | 10 | 3620.7 |
| | | 1 | 1 | 0 | 1 | 11 | 3414.6 |
| | | 0 | 0 | 1 | 1 | 12 | 3230.8 |
| | | 1 | 0 | 1 | 1 | 13 | 3065.7 |
| | | 0 | 1 | 1 | 1 | 14 | 2916.7 |
| | | 1 | 1 | 1 | 1 | 15 | 2781.5 |

SYSTEM FOR CONTRAST CONTROL USING LINEARIZED VARIABLE NETWORK OF PARALLEL RESISTIVE TERMS

TECHNICAL FIELD

The present invention generally relates to systems for controlling contrast, and in particular to a system for controlling contrast in a liquid crystal display.

BACKGROUND OF THE INVENTION

Liquid Crystal Displays (LCD) are widely used in consumer products such as computers, watches, refrigerators, calculators and video cassette recorders to name a few, they are also commonly used in man-machine interface (MMI) products as part of industrial control systems. LCDs are popular because they consume relatively little power, are inexpensive and allow a user to adjust brightness and contrast. Brightness control is necessary since the user may want to adjust brightness for factors such as ambient lighting conditions and user distance from the LCD. Contrast control permits the user to visually distinguish between foreground and background of the LCD.

Contrast of an LCD may be affected by operating temperature. As temperature decreases LCD fluid requires a higher voltage to maintain a desired contrast affect. Contrast voltage regulator circuitry also varies due to temperature and component value tolerances. Small changes in an output regulator, which drives the LCD, can visibly affect display contrast. In addition, there is a correlation between display brightness and contrast. Lower display brightness requires greater contrast in order to achieve the same level of viewability (e.g., a high-contrast, low-light output display can look similar to a low-contrast, high-light output display). Therefore, contrast control is desirable in that it provides compensation for these factors affecting display viewing properties.

LCDs employ a liquid crystal medium between two substrates. The liquid crystal medium may include various materials such as cholesterol, cyano-biphenyl groups, for example. When voltage is selectively applied to the two substrates, the arrangement of molecules of the liquid crystal medium is affected and hence contrast. The angle and direction in which the liquid crystal molecules orient themselves when the voltage is applied uniquely determines the magnitude of light transmittance. As the liquid crystal molecules are twisted with respect to an orthogonal direction (which defines maximum light transmittance), light transmittance varies. This phenomenon is marked in gray scale tones. The chemical makeup and composition of the liquid crystal medium is an element that determines the level of voltage applied. A voltage regulator circuit is typically employed (integrated within the display module) to establish the voltage applied to the LCD depending upon the contrast setting desired by the user. The voltage is typically controlled through a variable resistance provided by the user. The variable resistance is one element of a voltage divider used to bias the voltage regulator and hence, establish LCD contrast voltage. The resistance typically connects between a contrast node on the display (e.g., voltage regulator circuit within the display module) and common (or circuit ground).

Linear contrast control is generally desired because it allows the user to adjust contrast with ease and precision. For example, when a computer user adjusts a contrast control knob on a monitor, the user prefers a linear change between the foreground and the background as the knob is turned. Many conventional contrast control systems require complex and relatively expensive circuitry to afford for linear control.

In view of the above, a simple, relatively inexpensive system for providing a linear or other desired transfer function for contrast control is desired.

SUMMARY OF THE INVENTION

The present invention provides for a simple, relatively inexpensive, contrast control system. The system employs a plurality of parallel resistive elements, which may be selectively combined to provide a desired combined parallel resistance corresponding to a desired contrast setting. Switching individual resistive elements in or out of the combination affords for varying overall combined resistance. The employment of parallel resistive elements is highly conducive for a digital interface as compared to series resistive elements which often require employment of analog switching devices. The present invention employs N number of parallel resistive elements—N being an integer greater than 1 and sufficient to effect a desired transfer function.

The input mechanism for contrast can be in substantially in any format that affects a unique value or condition that can be distinguished by the system. The means for affecting the value are numerous and range from simple manual switch inputs into the system, to computer control through communication channels or programmed algorithms, for example. A preferred format for the contrast value conducive to computer systems is a binary format. This format is defined with x bits where the total number of setting is $2^x$. For example, a 4-bit value will yield 16 settings. Another format example is through discrete input bits. Each input bit corresponds to a contrast setting, similar to a multiplexer. For example, 16 settings require 16 input bits. Of course only one bit can be active at a time as may be achieved by use of a selector switch.

One particular aspect of the system of the present invention includes a host processor, a decoder and a resistive system. The processor provides for operational control of the system. Once the processor determines a desired contrast setting, it sends to the decoder a binary value corresponding to the desired contrast setting. The outputs of the decoder are connected to the resistive system and provide for electrical connection of individual resistive elements to circuit ground. The resistive system includes a plurality of resistors integrated in parallel. The parallel connection of the resistors provides for easy coupling to the decoder, and no complex latch arrangements of conventional series type systems are required. The combined parallel resistance of the resistive system establishes a resistance corresponding to the desired contrast setting. The decoder is operative to switch in or switch out each of the resistors of the resistive system to effect the desired resistance value. The total resistance is used in conjunction with a display contrast driver thereby affecting a voltage to the LCD corresponding to the desired contrast setting.

One particular aspect of the, present invention provides for a parallel resistive system operative to facilitate controlling contrast of a display. A decoder is operative to receive a binary value corresponding to a desired contrast setting of the display. A plurality of resistive elements are configured to be selectively combined in parallel to provide a plurality of predetermined cumulative resistance values. The decoder selectively switches in and out the resistive elements to effect a cumulative resistance value which is employed to facilitate controlling contrast of the display.

Another aspect of the present invention provides for a system for controlling contrast of a liquid crystal display. A processor controls general operations of the system and is configured to determine a desired contrast setting of the LCD. The processor is operative to assign a binary value corresponding to the desired contrast setting. A binary decoder is operatively coupled to the processor and is configured to receive the binary value of x bits (x being an integer) from the processor. A circuit includes N number of resistors (N being an integer greater than the number of input bits) adapted to be coupled in parallel to effect a plurality of cumulative parallel resistance values for the circuit. The circuit is operatively coupled to the binary decoder. The binary decoder selectively combines the resistors to effect a specific cumulative parallel resistance value corresponding to the desired contrast setting.

Yet another aspect of the present invention relates to a system for controlling contrast of a liquid crystal display. The system includes means for determining a desired contrast setting of the LCD; means for assigning a binary value corresponding to the desired contrast setting; means for receiving the binary value; means for effecting a plurality of cumulative parallel resistance values; and means for selectively controlling the means for effecting a plurality of cumulative parallel resistance values to correspond to the binary value.

Still another aspect of the present invention relates to a system for controlling contrast of a display. The system includes means for determining a desired contrast setting for the display; and means for selectively combining at least a portion of a plurality of resistive elements in parallel to achieve a desired cumulative resistance value in order to facilitate effecting the desired contrast setting.

Another aspect of the present invention relates to a system for controlling contrast of a liquid crystal display (LCD). The system includes a processor configured to determine a desired contrast setting of the LCD. The system further includes a resistive system including N number of resistive elements (N being an integer greater than one), at least a portion of the resistive elements configured to be selectively coupled in parallel to effect a plurality of cumulative parallel resistance values, the resistive system being operatively coupled to the processor. The processor selectively combines the resistive elements to effect a specific cumulative resistance value corresponding to the desired contrast setting.

Another aspect of the present invention relates to a system for facilitating controlling contrast of a display, including N number of resistive elements (N being an integer greater than one), at least a portion of the resistive elements configured to be selectively coupled in parallel to effect a plurality of cumulative parallel resistance values. The system further includes a display driver operatively coupled to the resistive elements, the display driver driving the display to effect a contrast level corresponding to a specific cumulative resistance value obtained by a particular selective combination of the resistive elements, the selective combination ranging from one to N of the resistive elements.

Yet another aspect of the present invention relates to a method for controlling contrast of a display, comprising the steps of: determining a desired contrast setting of the display; combining at least a portion of resistive elements in parallel to effect a cumulative resistance value corresponding to the desired contrast setting; and driving a display to have a contrast setting corresponding to the cumulative resistance value.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

FIG. 3*a* is a table corresponding to one specific range of values for resistive elements and combinations thereof for achieving a linear transfer function in accordance with the present invention;

FIG. 4*a* is a table corresponding to another specific range of values for resistive elements and combinations thereof for achieving a desired transfer function in accordance with the present invention;

DETAILED DESCRIPTION OF THE DRAWINGS

Figure 1:
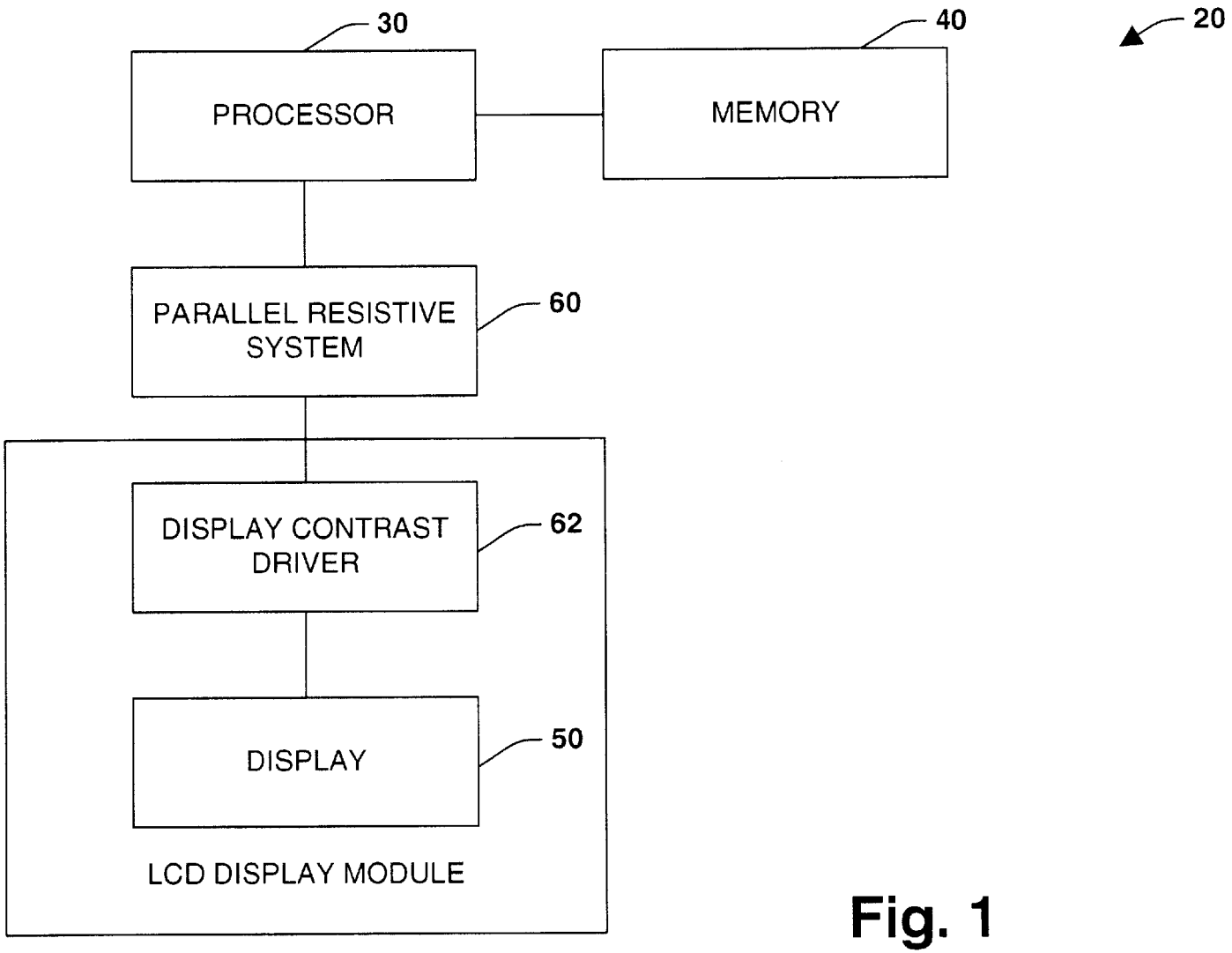
FIG. 1 is a schematic block diagram of a contrast control system in accordance with the present invention.

The present invention will now be described with reference to the drawings, wherein like reference numerals are used to refer to like elements throughout. The present invention relates to a contrast control system which is highly conducive for digital interfacing, and is a relatively inexpensive system to implement as compared to many conventional contrast control systems.

FIG. 1 is a representative schematic block diagram of a contrast control system 20 in accordance with the present invention. The system includes a processor 30 for controlling the general operations of the system 20. The processor 30 is programmed to control and to operate the various components of the system 20 in order to carry out the various functions described herein. The processor or CPU 30 can be any of a plurality of suitable processors, such as the 8051, 68HCII, 80C186, Pentium PRO and other similar processors. The manner in which the processor 30 can be programmed to carry out the functions relating to the present invention will be readily apparent to those having ordinary skill in the art based on the description provided herein and thus further discussion related thereto is omitted for sake of brevity.

A memory 40 operatively coupled to the processor 30 is also included in the system 20 and serves to store program code executed by the processor 30 for carrying out operating functions of the system 20 as described herein. The memory 40 also serves as a storage medium for storing information such as contrast control data. The memory may include read only memory (ROM) and random access memory (RAM).

The processor 30 is operatively coupled to a parallel resistive system 60 which includes a plurality of resistive elements that may be selectively combined in parallel to provide a cumulative parallel resistance value corresponding to a desired contrast setting of the display 50. The present invention employs N number of parallel resistive elements (e.g., resistors), wherein N is an integer greater than one and sufficient to effect a desired transfer function.

The parallel resistive system 60 is operatively coupled to a display contrast driver 62 for driving the display 50. The display 50 may be a liquid crystal display (LCD) or the like. The display 50 functions to display data or other information, and is capable of displaying both alphanumeric and graphical characters.

Contrast adjustment of the display may be initiated through software control, either by user input through interaction with the system directly (e.g., user-interface screen) or by an application file downloaded to a computerized product. In a preferred embodiment, the processor 30 derives a binary value (e.g., four bit binary value) which correspond to a resistance value in the range necessary for the desired contrast requirements for the display 50. The resistance setting is controlled by the binary value sent from the processor 30 to the parallel resistive system 60. The system includes a decoder 80 (FIG. 2) which may be part of the processor 30. For a four bit binary value, sixteen different contrast settings may be achieved.

Figure 2:
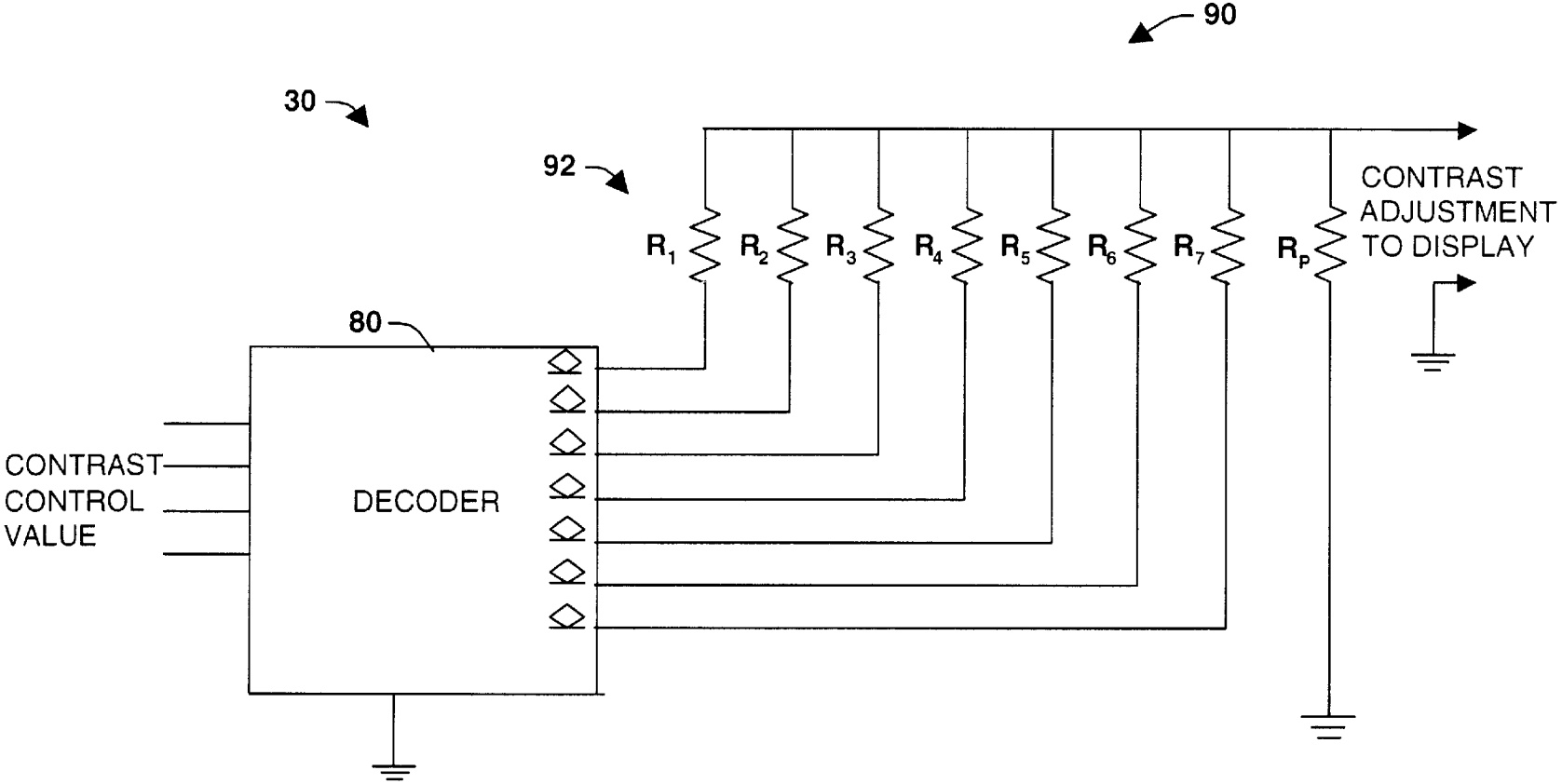
FIG. 2 is a representative schematic illustration of one specific example of a parallel resistive system in accordance with the present invention.

FIG. 2 is a representative schematic illustration of a preferred parallel resistive system in accordance with the present invention. The system 20 includes a decoder 80, which preferably has four inputs and seven outputs. It is to be appreciated that the system may employ m inputs (m being an integer) and N outputs (N being an integer) wherein (N>m). Thus, a four bit binary value corresponding to a desired contrast setting may be input from the processor 30 to the decoder 80, and the decoder 80 can switch in and out of a circuit 90 resistors 92 to effect a desired cumulative parallel resistance of the circuit 90 which is employed in setting contrast of the display 50.

Thus, the combination of resistors 92 of the parallel resistor system 60 for any given contrast setting is determined by the decoder 80. The decoder may contain any mechanism for determining the appropriate combination of resistors. For example, this mechanism can be in the form of electronic hardware such as combinational decoding logic, multiplexer circuitry or sequential state machines, or in the form of software algorithms such as a look-up table. The input to the decoder is the four-bit control value from the processor 30 and the outputs are used to switch the resistors 92 in or out of circuit 90. The outputs of the decoder 80 are preferably open-drain.

As can be seen, the parallel resistor system 30 includes a network of discrete resistive elements. One end of each resistive element $R_1$ to $R_7$ are operatively coupled to form a node of the circuit 90 (variable resistor). The other ends of the resistive elements $R_1$ to $R_7$ are operatively coupled to each of the open drain outputs of the decoder 80 to form a second node which is common to circuit ground. The upper range of cumulative resistance of the circuit 90 is determined by a single parallel resistive element $R_P$. Resistive element $R_P$ is preferably always "in circuit" and is the sole resistive value of the circuit 90 when all other resistive elements are switched out of the circuit 90. The lower limit for cumulative resistance of the circuit 90 is determined by the parallel combination of all resistive elements 92 ($R_1$ through $R_P$) in the circuit 90 when all are switched in.

Knowledge of the upper and lower limits for cumulative resistance that may be achieved by the parallel resistive system define a linear transfer function for effecting linear contrast adjustment of the display 50. The linear transfer function (LTF) is defined as follows:

$$\text{LTF} = \frac{\text{CUMULATIVE RESISTANCE OF CIRCUIT 90}}{\text{SELECTED CONTRAST CONTROL VALUE}}$$

The display driver 62 drives the display 50 based on the resistance of the parallel resistive system 30. The resistive system 30 is instantiated with a voltage divider integral with the display driver 62 and is used to bias the display driver circuit 62. The display driver 62 supplies voltage to the LCD display 50 in accordance with the bias condition corresponding to the parallel resistive system 30.

Figure 3B:
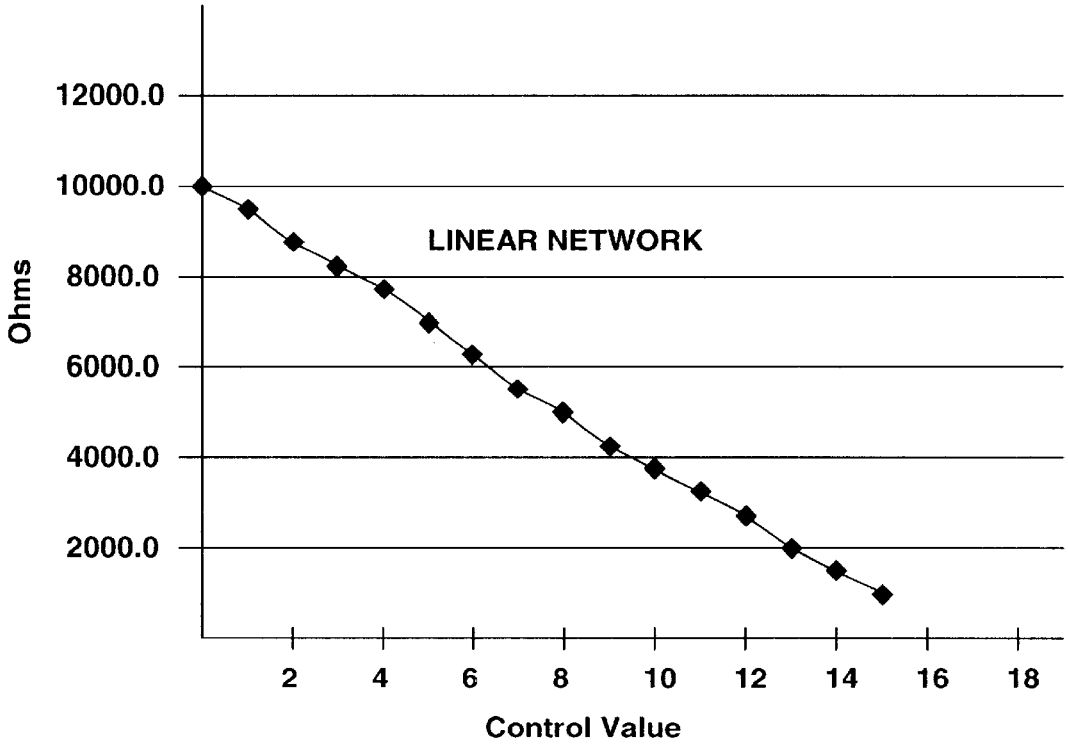
FIG. 3*b* is a graphical representation of a transfer function corresponding to a plurality of contrast adjustment settings of FIG. 3*a* in accordance with the present invention.

The upper and lower limits of the cumulative resistance values define a straight line for the transfer function has shown in FIG. 3*b*. Values may be chosen for each of the respective resistive elements $R_1$ through $R_7$ that individually in parallel with resistive element $R_P$ reside as a point on the line. This technique establishes nine of sixteen settings for contrast adjustment of the system 30. The remaining seven settings are determined by establishing parallel combinations of resistive elements $R_1$ through $R_P$ that will align in a linear fashion along the line. One specific example of values for resistive elements $R_1$ through $R_P$ as well as decoded combinations are provided in the table of FIG. 3*a*. It is to be appreciated that any suitable range of values and decoded combinations may be employed for carrying out the present invention and are intended to fall within the scope of the hereto appended claims. Furthermore, it is to be appreciated that any suitable number of resistive elements may be employed to carry out the present invention, and that one skilled in the art based on the teachings herein could readily determine and assign values for those resistive elements to effect a linear transfer function in accordance with the present invention.

Turning to the table in FIG. 3*a*, the leftmost column 110 includes calculated resistance values for $R_1$ through $R_P$ suitable for effecting the straight line of FIG. 3*b*. This column 110 also includes actual resistance values for the resistive elements 92. Column 120 lists bit binary values ($B_3$ through $B_0$) which are provided by the processor 30 to the decoder 80. In this example, the binary values are four bit, however, it is to be appreciated that other than four bit binary values may be employed along with other than seven resistive elements in carrying out the present invention. Column DEC includes the decimal equivalent value for the respective binary values. Column 130 lists the various combinations of resistive elements effected by the decoder 80. In particular, for a given binary value the decoder will switch in and out the resistive elements to effect a predetermined network resistance value (column 140). For example, if the processor 30 provides the binary value 1100 to the decoder 80, the decoder 80 will switch in resistive element $R_6$ and switch out resistive elements $R_1$–$R_5$ and $R_7$ so as to achieve a desired network resistance of 2000 Ohms (2581.6 Ohms actual). This value is substantially equivalent to:

$$\frac{1}{\frac{1}{R_6}+\frac{1}{R_P}}$$

If the processor 30 provides the binary value 0010 to the decoder 80, the decoder 80 will switch in resistive element $R_2$ and switch out resistive elements $R_1$, and $R_3$–$R_7$ so as to achieve a desired network resistance of 8666.7 Ohms (8746.9 Ohms actual). If the processor 30 provides the binary value 1101 to the decoder 80, the decoder 80 will switch in resistive elements $R_3$, $R_4$ and $R_6$ and switch out resistive elements $R_1$, $R_2$, $R_5$ and $R_7$ so as to achieve a desired network resistance of 1333.3 Ohms (1920.5 Ohms actual). The other possible iterations are readily apparent from the table of FIG. 3*a* and further discussion related thereto is omitted for sake of brevity.

The parallel resistive system 30 may be employed to customize the transfer function of the variable resistance. For example, in the case of a display used in a man-machine interface product, the specified resistance range of contrast is 0–10K Ohms. However, the effective range of contrast over standard operating temperature is contained within a more narrow range of resistance (e.g., approximately 6K to 8K ohms with an optimal setting at 7.5K ohms). Furthermore, it has been determined that contrast setting rolls off more quickly at temperature extremes but is relatively stable otherwise. Accordingly, the parallel resistive system 30 of the present invention may be tailored for such a device to provide a varying slope in the transfer function by selectively choosing the resistance values for the resistive elements 92 and combinations thereof as shown in the Table of FIG. 4*a*.

Figure 4B:
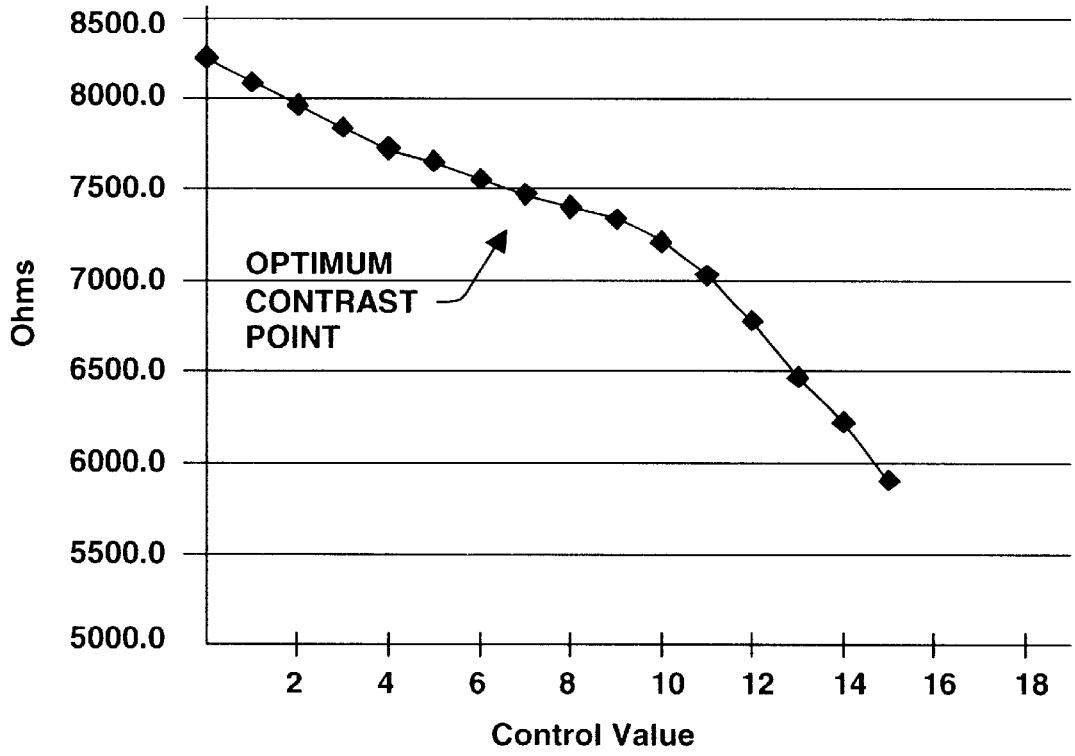
FIG. 4*b* is a graphical representation of a transfer function corresponding to a plurality of contrast adjustment settings of FIG. 4*a* in accordance with the present invention.

As can be seen from FIG. 4*b*, the transfer function includes many points (e.g., contrast settings) near the optimum contrast point and has less points away from the optimum contrast point. This arrangement of settings is achieved via selectively choosing the resistance values for $R_1$ through $R_P$ and the combinations thereof. The values for the resistance elements 92 and the combinations thereof (as obtained via the decoder 80) provided in the table of FIG. 4*b* is one specific representative range of resistance elements and combinations thereof to effect the transfer function depicted in FIG. 4*b*. It is to be appreciated that one skilled in the art could employ a greater number of resistive elements and determine suitable combinations thereof to effect a desired transfer function corresponding to a desired range of contrast settings for a particular display device. All such implementations of the present invention are intended to fall within the scope of the hereto appended claims.

Figures 5A, 5B:
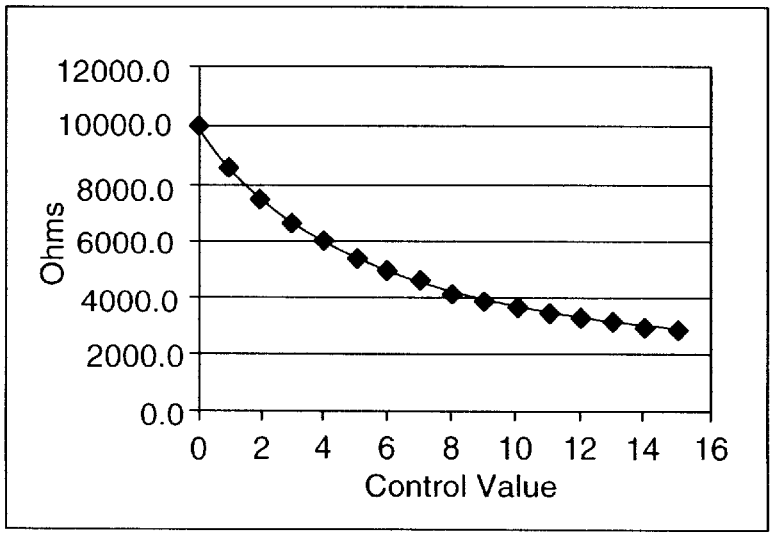
FIG. 5*a* is a table corresponding to a specific range of values for four parallel resistive elements and combinations thereof.
FIG. 5*b* is a graphical representation of a transfer function corresponding to a plurality of contrast adjustment settings of FIG. 5*a*.

It is to be appreciated that preferably at least seven resistive elements $R_1$ through $R_7$ are employed in carrying out the present invention. For example, a four-bit binary value may be employed as a control value from the processor. The four-bit binary value provides for sixteen individual resistance settings. Accordingly, it may be possible to employ as few as four parallel resistive elements to allow a direct interface with the four-bit binary control value so as to eliminate the need for decoder 80. However, it would not be practicable to achieve a linear range of resistance values using only four resistive elements. FIGS. 5*a* and 5*b* illustrate the use of only four parallel resistive terms. As can be seen from the line of FIG. 5*b*, a linear transfer function is not achieved. Employing three additional parallel resistive elements as in FIG. 3*a* allows for adjusting the transfer function so as to be shaped linear as illustrated in FIG. 3*b*. As an alternative, the resistive elements 92 may be weighted and invoked in such a way as to shape the transfer function in a desired manner (e.g., change slope, include steps, provide asymptotes).

Although the present invention has been primarily described within the context of employing a processor in connection with a decoder to selectively combine the resistive elements to effect a desired cumulative resistance value, it is to be appreciated that other techniques may be employed to carry out the present invention. For example, a processor (e.g., having output pins) could switch the resistive elements in and out directly and employ a look-up table stored in memory to allow the processor to match a user input with a corresponding combination of resistive elements to effect a cumulative resistance value corresponding to the user input.

In another embodiment, analog switches may be employed rather than a processor. Switch inputs may be input to a decoder operatively coupled to a plurality of resistive elements as described herein to effect a desired cumulative resistance value.

What has been described above are preferred embodiments of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A parallel resistive system operative to facilitate controlling contrast of a display, comprising;

a decoder operative to receive a binary value corresponding to a desired contrast setting of the display;

a plurality of resistive elements configured to be selectively combined in parallel to provide a plurality of predetermined cumulative resistance values with more cumulative resistance values near an optimum contrast point and less cumulative parallel resistance values away from the optimum contrast point to compensate for temperature extremes; and wherein the decoder selectively switches in and out the resistive elements to effect a cumulative resistance value which is employed to facilitate controlling contrast of the display.

2. The system of claim 1, the decoder operatively coupled to a processor which provides the binary value.

3. The system of claim 1, the plurality of resistive elements including N resistive elements (N being an integer greater than one).

4. The system of claim 1, the plurality of resistive elements including at least seven resistive elements.

5. The system of claim 1, the plurality of resistive elements being operatively coupled to a display contrast driver.

6. The system of claim 3 providing a resistive connection to the display contrast driver corresponding to the cumulative parallel resistance of the plurality of resistive elements.

7. A system for controlling contrast of a liquid crystal display, comprising:

a processor for controlling general operations of the system, the processor configured to determine a desired contrast setting of the LCD, the processor operative to assign a binary value corresponding to the desired contrast setting;

a binary decoder operatively coupled to the processor, the binary decoder configured to receive the binary value of x bits from the processor;

a circuit including N resistors (N being an integer greater than x) configured to be coupled in parallel to effect a plurality of cumulative parallel resistance values for the circuit so as to define a substantially linear transfer function, the substantially linear transfer function providing a varying slope over different ranges of cumulative resistance values to compensate for temperature extremes with more cumulative resistance values near an optimum contrast point and less cumulative parallel resistance values away from the optimum contrast point, the circuit being operatively coupled to the binary decoder; and wherein the binary decoder selectively combines the resistors to effect a specific cumulative parallel resistance value corresponding to the desired contrast setting.

8. The system of claim 7, N being greater than six.

9. The system of claim 7, the plurality of resistors being operatively coupled to a display contrast driver.

10. The system of claim 9 providing a resistive connection to the display contrast driver corresponding to the cumulative parallel resistance of the plurality of resistors.

11. A system for controlling contrast of a liquid crystal display, comprising:

means for determining a desired contrast setting of the LCD;

means for assigning a binary value corresponding to the desired contrast setting;

means for receiving the binary value;

means for effecting a plurality of cumulative parallel resistance values from a plurality of resistive elements so as to define a substantially linear transfer function, the substantially linear transfer function providing a varying slope over different ranges of cumulative parallel resistance values to compensate for temperature extremes with more cumulative parallel resistance values near an optimum contrast point and less cumulative parallel resistance values away from the optimum contrast point; and means for selectively controlling the means for effecting a plurality of cumulative parallel resistance values to correspond to the binary value.

12. A system for controlling contrast of a display, comprising:

means for determining a desired contrast setting for the display; and means for selectively combining M of N resistive elements (M and N being an integer greater than one) operable to effect a substantially linear transfer function in parallel to achieve a desired cumulative resistance value in order to facilitate effecting the desired contrast setting, the substantially linear transfer function providing a varying slope over different ranges of cumulative parallel resistance valves to compensate for temperature extremes with more cumulative parallel resistance values near an optimum contrast point and less cumulative parallel resistance values away from the optimum contrast point.

13. A system for controlling contrast of a liquid crystal display (LCD), comprising:

a processor configured to determine a desired contrast setting of the LCD;

a resistive system including N resistive elements, M of said N resistive elements configured to be selectively coupled in parallel to effect a plurality of cumulative parallel resistance values (M and N being an integer greater than one), the resistive system being operatively coupled to the processor; and wherein the processor selectively combines the resistive elements to effect a specific cumulative resistance value corresponding to the desired contrast setting so as to define a linear transfer function via a relationship: cumulative resistance/selected contrast value, the linear transfer function having a varying slope over different ranges of cumulative parallel resistance values to compensate for temperature extremes with more cumulative resistance values near an optimum contrast point and less cumulative parallel resistance values away from the optimum contrast point.

14. A system for facilitating controlling contrast of a display, comprising:

N resistive elements, M of said N resistive elements configured to be selectively coupled in parallel to effect a plurality of cumulative parallel resistance values coincident with a substantially linear transfer function, the substantially linear transfer function having more cumulative parallel resistance values near an optimum contrast point and less cumulative parallel resistance values away from said optimum contrast point (M and N being an integer greater than one); and a display driver operatively coupled to the resistive elements, the display driver driving the display to effect a contrast level corresponding to a specific cumulative resistance value obtained by a particular selective combination of the resistive elements, the selective combination ranging from one to N of the resistive elements.

15. A liquid crystal display device including the system of claim 14.

16. A method for controlling contrast of a display, comprising:

determining a desired contrast setting of the display;

combining M of N resistive elements (M and N being an integer greater than one) in parallel to effect a cumulative resistance value corresponding to the desired contrast setting, wherein a relationship (cumulative resistance value/desired contrast setting) defines a substantially linear transfer function, the substantially linear transfer function having more cumulative resistance values near an optimum contrast point and less cumulative resistance values away from the optimum contrast point to compensate for temperature extremes; and driving a display to have a contrast setting corresponding to the cumulative resistance value.

* * * * *